US010653935B2

(12) United States Patent
Galli

(10) Patent No.: US 10,653,935 B2
(45) Date of Patent: May 19, 2020

(54) PROCESS AND SYSTEM FOR MEASURING A REACTION TIME AT THE START OF A RACE

(71) Applicant: Swiss Timing Ltd, Corgemont (CH)

(72) Inventor: Reto Galli, Muenchenbuchsee (CH)

(73) Assignee: Swiss Timing Ltd, Corgemont (CH)

( * ) Notice: Subject to any disclaimer, the term of this patent is extended or adjusted under 35 U.S.C. 154(b) by 583 days.

(21) Appl. No.: 15/251,463

(22) Filed: Aug. 30, 2016

(65) Prior Publication Data

US 2017/0065871 A1 Mar. 9, 2017

(30) Foreign Application Priority Data

Sep. 3, 2015 (EP) ..... 15183711

(51) Int. Cl.
*A63B 71/06* (2006.01)
*G07C 1/22* (2006.01)
(Continued)

(52) U.S. Cl.
CPC ..... *A63B 71/0605* (2013.01); *A63B 24/0062* (2013.01); *A63K 3/023* (2013.01);
(Continued)

(58) Field of Classification Search
CPC ..... A63K 3/023; A63K 3/02; A63B 69/0053; A63B 2071/0627; A63B 2220/836;
(Continued)

(56) References Cited

U.S. PATENT DOCUMENTS 5,467,652 A * 11/1995 Richards ..... A63K 3/023 482/19
8,317,659 B2 * 11/2012 Woodson ..... A63B 24/0062 482/11

(Continued)

FOREIGN PATENT DOCUMENTS

CH 707 401 A2 6/2014
WO WO 2015/106077 A1 7/2015

OTHER PUBLICATIONS

European Search Report dated Mar. 14, 2016 in European Application 15183711, filed on Sep. 3, 2015 ( with English translation of Categories of cited documents and written opinion).

*Primary Examiner* — William H McCulloch, Jr.
*Assistant Examiner* — Ankit B Doshi
(74) *Attorney, Agent, or Firm* — Oblon, McClelland, Maier & Neustadt, L.L.P.

(57) ABSTRACT

The process enables a reaction time of an athlete at the start of a race to be measured with a personalized transponder module positioned on the athlete and a base station. The module comprises a receiver unit, a processing unit, a transmitter unit for data signals and a motion sensor to supply measurement signals to the processing unit. The module is activated by a received wake-up signal and a measurement of the movement is performed by the sensor at the start of the race. The data signals are transmitted to the base station and a determination of the reaction time of the athlete at the start of the race is performed to determine a possible false start if the reaction time is below a determined time threshold following the starting signal.

17 Claims, 3 Drawing Sheets

(51) Int. Cl.
*A63K 3/02* (2006.01)
*A63B 24/00* (2006.01)

(52) U.S. Cl.
CPC ..... *G07C 1/22* (2013.01); *A63B 2220/34* (2013.01); *A63B 2220/36* (2013.01); *A63B 2220/40* (2013.01); *A63B 2220/836* (2013.01); *A63B 2225/50* (2013.01)

(58) Field of Classification Search
CPC . A63B 69/0028; A63B 24/0062; A63B 69/00; A61B 5/162; G07C 1/24
See application file for complete search history.

(56) References Cited

U.S. PATENT DOCUMENTS

2014/0221159 A1* 8/2014 Lawrence ..... A63K 3/023 482/8
2015/0116497 A1* 4/2015 Doval ..... G01S 7/412 348/157
2015/0202494 A1* 7/2015 Hollenbach ..... G06K 9/00342 700/91

* cited by examiner

PROCESS AND SYSTEM FOR MEASURING A REACTION TIME AT THE START OF A RACE

This application claims priority from European Patent Application No 15183711.9 filed Sep. 3, 2015, the entire disclosure of which is hereby incorporated herein by reference.

FIELD OF THE INVENTION

The invention relates to a process for measuring or determining a reaction time of an athlete at the start of a race.

The invention also relates to a system for measuring or determining a reaction time of an athlete at the start of a race to be implemented by the process.

BACKGROUND OF THE INVENTION

In a sports competition such as a sprint race in athletics, each athlete starts from a starting block. In high-level competitions, it is necessary to measure the reaction time of each athlete at the instant of leaving the starting block. This is generally performed by electronic or optical devices connected to a base station for the determination of any false start. According to the rules of these athletic competitions, it is specified that a reaction time below a time threshold of 0.1 s must be considered a false start.

Currently, two technologies are principally provided for measuring the reaction times of athletes from a starting block. One of these technologies consists of measuring the force with which the athlete presses against a block of the starting block with at least one foot, as it is described in patent EP 2 532 400 B1. Another of these technologies consists of determining the backward acceleration of the block, against which one of the athlete's feet rests and presses at the start, as described in the patent application WO 99/32889 A2. According to these two technologies, it is possible to detect the reaction of each athlete before their movement at the instant of departure is even visible to the human eye. In the event of a false start, the two technologies mentioned above can provide a graphic representation of the signals of the sensor arranged on the starting block as a function of time. This enables a judge or judges to consult the graphs to determine a false start. However, these technologies do not allow detection of every type of movement of the athlete for determination of a false start, which constitutes a drawback.

It should also be noted that when an array of sensors is arranged only on the starting block, this does not allow every movement, particularly in an upper part of the body of the athlete, to be detected that is likely to enable a false start to be determined. Moreover, it is very difficult to differentiate between the most significant variations in pressure on the starting block of a strong athlete compared to a weaker athlete such as a junior to be able to assess a false start.

At the instant the starter gives the signal to prepare for the start, an athlete can still move until he presses against the block and is then considered ready for the start. Any movement that takes place before 0.1 s of the start signaled by a starting gun of the starter must be considered a false start. This means that a movement of the athlete resulting from a loss of contact of the athlete's hand on the ground is considered a false start after the signal of the starting gun. Conversely, any movement of the athlete before the signal for preparation by the starter with a disconnection in time of the measurement device will be considered preparation movements before starting and must not be considered a false start. In this scenario, the athlete can be given merely a disciplinary warning.

A starting block for an athletics race is also known from patent U.S. Pat. No. 5,467,652. The starting block comprises a longitudinal anchor bar, on which are placed two bearing blocks for the athlete's feet respectively positioned on each side of the bar. Each block comprises an angularly adjustable bearing surface for a foot of an athlete. Each bearing surface is covered with a pressure pad of conductive elastomer construction. The sensors of the pressure pads are connected to a control and display module by electric cables to supply varying analog output signals depending on the measured pressure. A start signal for a race supplied by an indicator is transmitted via an electric cable to the module. The starting block is capable of measuring, recording and displaying the pressure levels detected on each bearing surface, the time that has passed between the start signal and the athlete's start as a function of the variation in the pressure measured on the blocks and indicate false starts. As indicated above, this does not allow detection of every type of movement of the athlete at the instant of departure to determine a false start, and this constitutes a drawback.

The patent application FR 2 089 076 can also be cited, which describes a device capable of determining a false start for a foot race. To achieve this, a contactor is fixed to a rear portion of a block of a starting block. This contactor controls an electronic circuit in order to signal any false start. Not every movement of the athlete at the instant of departure can be detected for determination of a false start, and this constitutes a drawback.

SUMMARY OF THE INVENTION

The aim of the invention is therefore to remedy these drawbacks of the abovementioned prior art by proposing a process for measuring or determining a reaction time of an athlete at the start of a race.

For this, the invention relates to a process for measuring or determining a reaction time of an athlete at the start of a race by means of a personalized transponder module positioned on the athlete and a base station of a measurement system, wherein the transponder module comprises at least a signal receiver unit, a processing unit for data, measurements or commands, a transmitter unit for data and/or measurement and/or command signals, and at least one motion sensor to supply measurement signals to the processing unit, wherein the process comprises the following steps:

activating the personalized transponder module following the receipt of a wake-up signal in the receiver unit, measuring a movement of the athlete by the motion sensor following at least the signaling of a starting signal of the race, transmitting measurement signals directly or formatted with determination of the variations in movement following the starting signal in the processing unit by the transmitter unit to the base station, and determining a reaction time of the athlete at the start of the race in the base station or on the basis of the determination in the processing unit of the transponder module for determination of a possible false start if the defined reaction time is below a time threshold determined after generation of the starting signal.

Particular steps of the process for measuring or determining a reaction time of an athlete at the start of a race are defined in dependent claims 2 to 9.

An advantage of the measurement process lies in the fact that with the transponder module placed on a part of the athlete's body, it is possible to configure the measurement system to allow differentiation between every movement of the athlete before the real preparation for the start of the race and the actual instant the race starts when the reaction time must be assessed. This allows the starter to make an appropriate decision as to whether the athlete has made a false start or not.

Advantageously, each transponder module can be woken at the instant of the start preparation signaled by the starter coming from a base station or a race start point such as an emitter of a starting block, or directly at the instant the starting gun is fired. As soon as the transponder module is woken up, it can be considered easy to determine the reaction time of each athlete following the start signal of a starter's starting gun.

For this, the invention also relates to the system for measuring or determining a reaction time of one or more athletes at the start of a race for implementing the measurement process, wherein the measurement system comprises at least one a personalized transponder module positioned on an athlete and a base station, wherein said transponder module comprises at least a signal receiver unit, a processing unit for data, measurements or commands, a transmitter unit for data and/or measurement and/or command signals, and at least one motion sensor to supply measurement signals to the processing unit, wherein the transponder module is configured to be woken up by a wake-up signal received by the receiver unit in order to enable the motion sensor to measure a movement of the athlete following a signaling of the start of the race, and wherein the base station or the processing unit is arranged to determine a reaction time at the start of the race on the basis of measurement signals from the motion sensor.

Particular embodiments of the system for measuring or determining a reaction time of an athlete at the start of a race are defined in dependent claims 11 to 13.

BRIEF DESCRIPTION OF THE DRAWINGS

The aims, advantages and features of the process and system for measuring or determining a reaction time of an athlete at the start of a race according to the invention will become clearer from the following description of at least one non-restrictive embodiment illustrated in the drawings.

DETAILED DESCRIPTION OF THE INVENTION

In the following description, all the elements of the system for measuring or determining a reaction time of an athlete at the start of a race for implementing the measurement process well known to a person skilled in the art in this technical field will only be described in a simplified manner.

Figure 1:
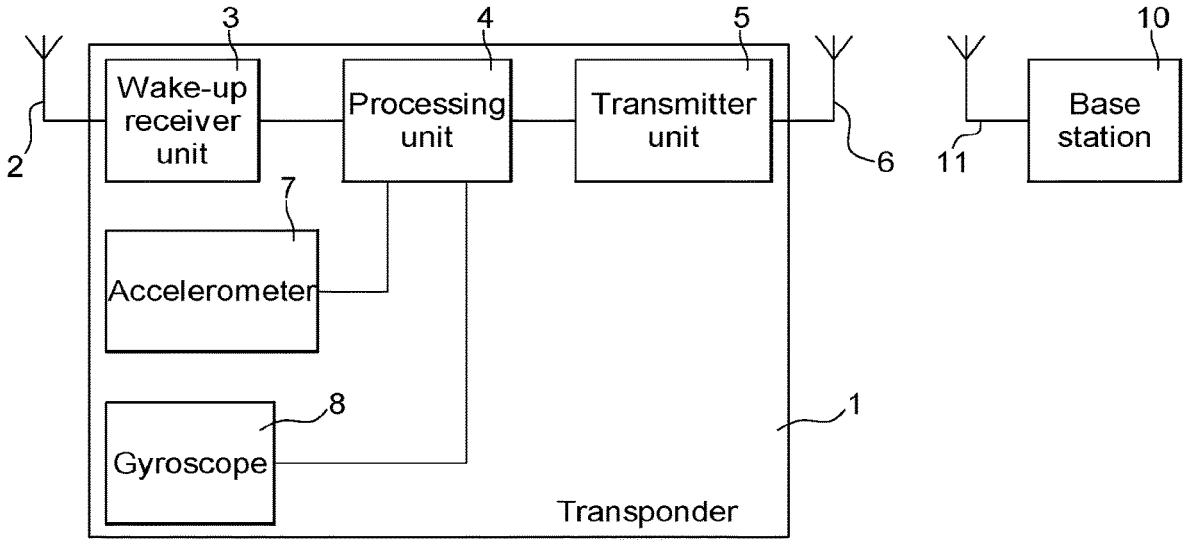
FIG. 1 schematically shows the main elements of a system for measuring or determining a reaction time of an athlete at the start of a race according to the invention.

FIG. 1 schematically shows the main elements that make up a system for measuring or determining a reaction time of an athlete at the start of an athletics race. To achieve this, the system comprises one or more transponder modules or circuits 1 and at least one base station 10 for communication of data and/or measurements and/or commands between the transponder modules or circuits 1 and the base station 10. Each transponder module 1 for the competition is arranged on a part of the athlete's body, e.g. in a race number bib, and is thus personalized to the athlete that wears it. The transponder module 1 is preferably arranged on an upper part of the athlete's body, such as the chest in order to detect the rotation of the upper body of the athlete to determine a reaction time at the start of the race.

The transponder module 1 can be active with a solar battery or cell integrated into the module or passive being supplied by the receipt of a traditional interrogation signal.

The transponder module or circuit 1 comprises a wireless signal receiver unit 3 to receive via an antenna 2 data or command signals 3 coming from a base station 10 or an emitter arranged in a starting block of the measurement system or along a race track. The signals received by the antenna 2 linked to the receiver unit 3 are preferably signals that enable the transponder module 1, which is in a resting state before receipt of such signals, to be woken up. As indicated above, these wake-up signals are generated by the base station 10 or by an emitter of the starting block or along the race track after the preparation signal for the start of an athletics race in particular or directly at the instant the starting gun is fired. The gun can be an electronic gun or a powder gun with a transducer and can also be part of the measurement system.

The transponder module 1 also comprises a processing unit 4, which can be a state machine, a processor or a microcontroller for management of all the data or commands or measurements to be received or transmitted. The processing unit 4 receives the data or commands formatted in the receiver unit 3 to also wake up all the components that make up the transponder module 1. The processing unit 4 is again connected to a signal transmission unit 5 by an antenna 6 for a transmission to the base station 10. The base station 10 can be a race chronometer system and comprises an antenna 11 for transmitting or receiving signals.

The transponder module 1 again comprises at least one motion sensor 7, 8 connected to the processing unit 4 to supply measurement signals either continuously or intermittently to the processing unit 4 once the transponder module has woken up. The transponder module 1 can comprise an accelerometer 7 and/or a gyrometer or gyroscope 8 as motion sensor. An accelerometer 7 is preferably provided to measure the acceleration of an athlete at the instant of the start of the race and a gyroscope 8 to determine a rotational speed and an angle of rotation of the upper part of the body of the athlete in order to determine a reaction time at the start of a race. The measurement signals are supplied directly to the processing unit 4.

The accelerometer 7 used can be an accelerometer with one, two or three measurement axes to supply a measurement signal relating to a variation of movement of said module or a level of vibrations of said module such as spasms or contractions or trembling of the athlete before the start of the race. The gyroscope 8 can also be a gyroscope with one, two or three measurement axes and form a detection assembly with the accelerometer to supply a measurement signal relating to the rotational speed of the upper body of the athlete and the angle of rotation to determine a reaction time at the start of the race.

The measurement signals of the accelerometer 7 and the gyroscope 8 or other types of sensors are sampled by the processing unit 4. The measurement signals can be transmitted directly to the base station 10 using the wireless transmitter unit 5. However, the measurement signals can be improved in particular after filtering and then stored and/or sent subsequently to the base station 10. It is also possible to process the data of different sensors and any detection event such as a jump. It is also possible to process the movement characteristics extracted, such as the pace frequency, and transmit this information to the base station 10 in addition to the actual data of the accelerometer 7 and the gyroscope 8.

It should also be noted that the signals received by the antenna 2 linked to the receiver unit 3 can be signals at low frequency in the order of 125 kHz, while the signals transmitted by the antenna 6 linked to the transmitter unit 5 can be UHF signals at a frequency ranging between 300 MHz and 3000 MHz. However, it can be conceivable to have a transponder module with a single switchable receiver and emitter antenna for receipt or emission of data signals. In this scenario, it is preferable to have a receipt of at least one wake-up signal and an emission of data signals at a similar carrier frequency with an FSK, BPSK, QPSK or ON-OFF keying modulation of the transmitted data.

Figure 2:
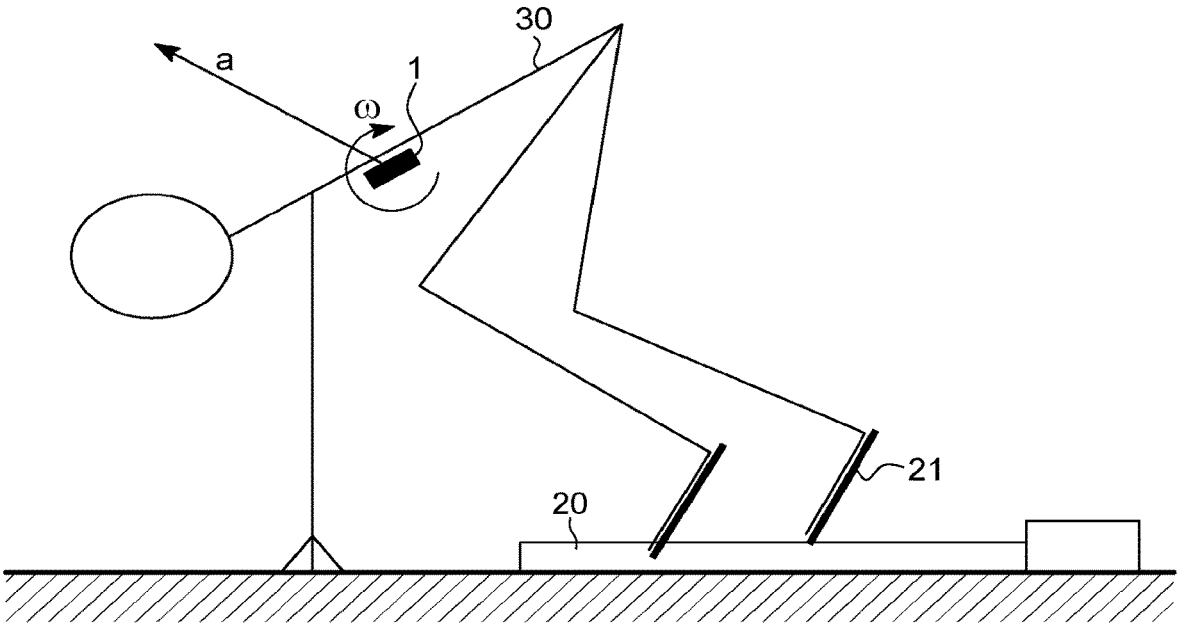
FIG. 2 schematically shows an athlete fitted with a transponder module in the starting position on a starting block according to the invention.

For understanding of the process for determining a reaction time at the start of a race, FIG. 2 shows an athlete fitted with a transponder module in the starting position on a starting block according to the invention. The two feet of the athlete 30 are resting against two bearing blocks 21 of a starting block 20 placed on and fixed to the ground of the race track. The athlete 30 is fitted with a preferably active transponder module 1. The transponder module 1 is fitted with at least one motion sensor and preferably with two motion sensors such as the accelerometer and the gyroscope.

After the command to prepare for the start by the starter, the athlete can move as far as his final position before the start. He is thus supposed to remain ready up to the instant the starting gun is fired by the starter. During this preparation phase, there must be no acceleration sensed by the accelerometer other than the earth's gravity. Moreover, the gyroscope must not sense any rotation of the body. After the starting gun has fired, the athlete pushes against the bearing blocks 21 for his start of the race. From this instant, the accelerometer measures an acceleration upwards and forwards a and the gyroscope measures a rotation or speed of rotation w, given that the athlete moves from a crouched position where his body is inclined forward approximately 120° to an upward (straight) position at the instant of departure. The measurements conducted by the two sensors are processed by the processing unit and managed directly in said processing unit or are transmitted directly to a base station for processing. The wake-up signal of the transponder module can be generated by an emitter linked to the starting block 20 or directly from the base station on command of the starter, for example.

Figure 3A:
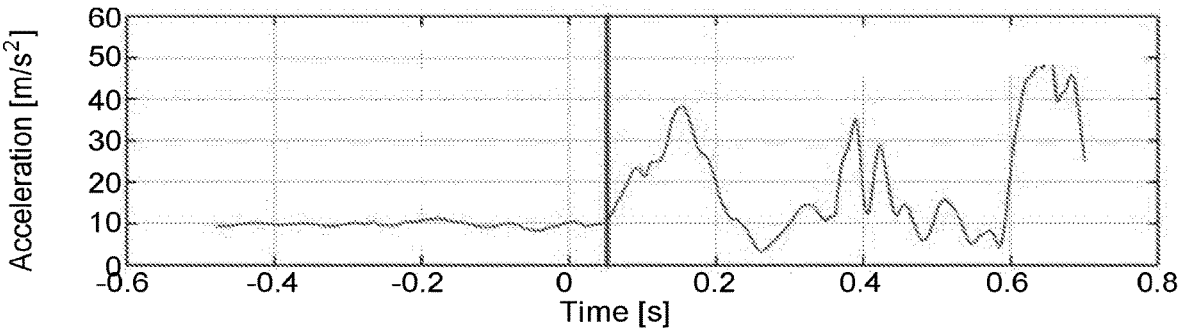
FIGS. 3*a* to 3*c* are graphs showing the acceleration time of the athlete at the instant of departure, the rotation speed of the upper body wearing the transponder module and the angle of rotation of the body in relation to a start confirmation threshold.
Figure 3B:
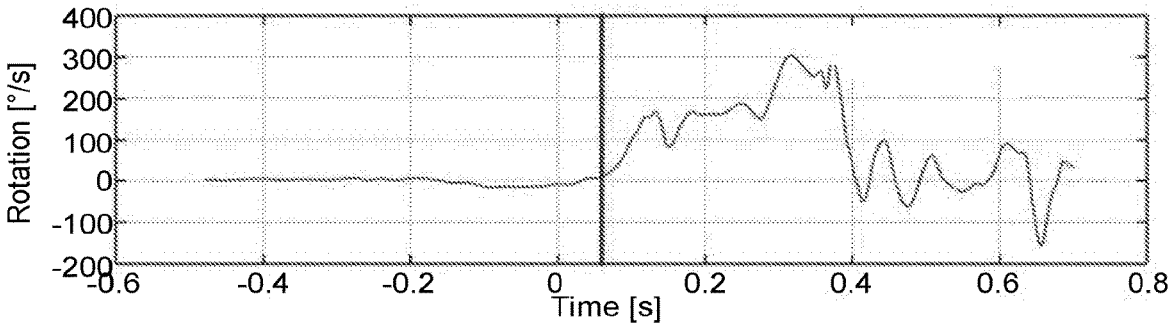
Figure 3C:
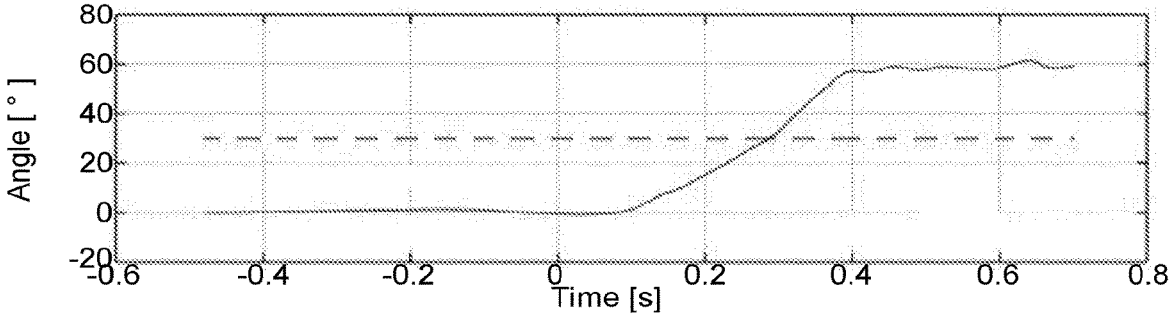

To determine a reaction time at the instant of the start of a race, the following FIGS. 3*a*, 3*b* and 3*c* show the absolute acceleration or, according to the X and Y axes measured by the accelerometer, the rotation speed and the angle of rotation of the athlete with the transponder module in the period after generation of the starting gun shot signaling the start of the race. The angle of rotation of FIG. 3*c* is the integration of the signal of FIG. 3*b* and is not useful for detecting the reaction time, but the signal of FIG. 3*c* is used subsequently to determine if there has truly been a false start.

It is thus possible to observe the signals of the sensors during a start of a sprint race. A combination of the measurements of the sensors can serve to determine whether this is a true start of the athlete or merely movements preceding the real start of the race. The beginning of an increase in acceleration of the athlete in FIG. 3*a* is shown by a vertical line, as is the beginning of a rotation or rotation speed of the upper part of the body of the athlete in FIG. 3*b*. As mentioned above, the angle of rotation is shown in FIG. 3*c* to subsequently determine a real false start. What appears most quickly is used as a trigger to determine the reaction time of the athlete in particular after receipt of the signals from the transponder modules of each athlete at the start in the base station.

The detection of these events in the signals of the sensors can be performed in the transponder module, which transmits these events, or in the base station if the transponder transmits the measurement signals of the sensors directly. The base station also receives the starting signal of the race generated by the firing of the starting gun by the starter. The time difference between the starting signal and the beginning of movement defines the reaction time, which must not be less than the time threshold of 0.1 s to validate a good start of the athlete. In general, the base principle of detection described for this invention is relatively similar to that performed by the sensors arranged in the starting block, but with the difference that the sensors of the transponder module measure the movement of the athlete directly, whereas with the sensors arranged in the starting block the movement of the athlete is determined indirectly. This can render the determination of the reaction time at the start of the race less precise with the sensors in the starting block, since this does not allow every type of movement to be detected.

With the process for determining the reaction time at the start of a race, it is also necessary to take into account the effect of spasms or contractions, of trembling and the start of the athlete. A substantial problem with the solution of the standard starting block is that the contractions of strong athletes cause more variations in pressure on the starting block than a start of a junior athlete. Thus, contractions sometimes lead to erroneously triggered reaction times during false start detection. Although an athlete can be given a disciplinary warning for contractions by the starter, this is not considered as a false start. Only the movement that results from loss of contact of the athlete's hands from the ground should be considered with respect to the reaction time.

Using the acceleration of the motion sensor such as the accelerometer can lead to the same problem as the measurement conducted in the starting block. The range of acceleration between athletes can be very substantial. On the other hand, the additional use of a gyroscope in the transponder module can provide a sure indication of the rotation of the upper part of the body of the athlete at the instant of departure. This enables an elite athlete and a junior athlete to be judged in the same manner without taking into account the range of pressures or acceleration of each athlete on the starting block.

Although the inclination of the upper part of the body in the crouched position and the inclination of the body after the first paces of the athlete, or after the first strides, can vary between athletes, it can be concluded that after a rotation of the body of about 30°, the athlete has truly left the blocks. The start can also be confirmed with his hands, which are no longer in contact with the ground at the start. By integrating the rotation speed in FIG. 3*b* measured by the gyroscope, the angle of rotation of the upper part of the body is obtained in FIG. 3*c*.

Thus, the measurement system for implementing the process for determining the reaction time can detect the start from the acceleration or rotation with a very low threshold and then confirm that it is a real start, when the angle of rotation increases above a defined threshold as shown in broken lines in FIG. 3*c*. If the angle remains below the threshold, e.g. below 30° of the angle of rotation, this indicates contractions or spasms of the athlete before the start, which must be ignored for determination of the reaction time at the start.

Trembling can be eliminated from the analysis in a similar manner to the detected contractions. Therefore, there are two cases to consider. Firstly, trembling cannot have any rotation component. Thus, if a significant acceleration is detected, which is not followed directly by a significant rotation, then this must not be used as a trigger for determining a reaction time. Secondly, there can be rotation components in the trembling. In this case, there can be a detection of significant acceleration and the speed of rotation. However, the angle of rotation does not increase continuously, but will oscillate around 0°. Thus, if significant acceleration or rotation is detected that is not followed by a continuous increase in the angle of rotation, this must not be used as a trigger for determining a reaction time and thus a possible false start.

Several variants of the process and system for measuring or determining a reaction time of an athlete at the start of a race can be conceived by a person skilled in the art on the basis of the description just given without departing from the framework of the invention defined by the claims. The transponder module can comprise several other sensors such as a temperature sensor, for example. The transponder module can be arranged at other locations on the body of the athlete for a sports competition other than athletics, for example, where a reaction time at the start of the race must be monitored.

The invention claimed is:

1. A process for measuring or determining a reaction time of an athlete at a start of a race by means of a personalized transponder module positioned on the athlete and a base station of a measurement system, wherein the personalized transponder module comprises at least a signal receiver configured to receive signals, data and/or commands, a processor for data, measurements or commands, a transmitter configured to transmit data and/or measurement and/or command signals, and at least one motion sensor to supply measurement signals to the processor, wherein the process comprises the following steps:

activating the personalized transponder module following receipt in the receiver of a wake-up signal provided by an emitter external to the personalized transponder module, measuring a movement of the athlete by the at least one motion sensor following at least signalling of a starting signal of the race, transmitting the measurement signals from the at least one motion sensor directly or formatted by the processor with determination of variations in movement following the starting signal by the transmitter to the base station, and determining the reaction time of the athlete at the start of the race in the base station or using the processor of the personalized transponder module for determination of a possible false start if the reaction time is below a time threshold determined after generation of the starting signal.

2. The measurement process according to claim 1, in which the at least one motion sensor is an accelerometer with one, two or three measurement axes, wherein after having activated the personalized transponder module by the wake-up signal, the accelerometer measures an acceleration of the athlete following the signalling of the starting signal of the race, and wherein the transmitter transmits the measurement signals from the at least one motion sensor directly to the base station, or data signals processed on a basis of a determination of the variations in acceleration in the processor following the start of the race.

3. The measurement process according to claim 1, in which the personalized transponder module is arranged on an upper part of a body of the athlete and in which the at least one motion sensor is a gyroscope with one, two or three measurement axes, wherein after having activated the personalized transponder module by the wake-up signal, the gyroscope measures a rotation speed of the personalized transponder module on the athlete following the signalling of the starting signal of the race, and wherein the transmitter transmits the measurement signals from the at least one motion sensor directly to the base station, or data signals processed on a basis of a determination of variations in rotation of the personalized transponder module in the processor following the start of the race.

4. The measurement process according to claim 3, in which the at least one motion sensor includes an accelerometer with one, two or three measurement axes, wherein after having activated the personalized transponder module by the wake-up signal, the gyroscope or the accelerometer and the gyroscope supply measurement signals to the processor to determine directly in the processor the reaction time following the signalling of the starting signal of the race on the basis of a threshold of an increase in acceleration and/or of a speed of rotation of the personalized transponder module before transmitting the data signals to the base station to determine a possible false start if a reaction time is below the time threshold determined after the generation of the starting signal.

5. The measurement process according to claim 1, in which the personalized transponder module is arranged on an upper part of a body of the athlete and in which the personalized transponder module comprises two motion sensors, which are an accelerometer with one, two or three measurement axes and a gyroscope with one, two or three measurement axes, wherein after having activated the personalized transponder module by the wake-up signal, the accelerometer and the gyroscope measure acceleration of the athlete and a rotation speed of the personalized transponder module on the athlete following the signalling of the starting signal of the race, and wherein the transmitter transmits first measurement signals of the accelerometer and the gyroscope supplied by the processor directly to the base station, or data signals processed on a basis of determination of variations in acceleration and variations in rotation of the personalized transponder module in the processor following the start of the race.

6. The measurement process according to claim 5, wherein after having activated the personalized transponder module by the wake-up signal, the gyroscope or the accelerometer and the gyroscope supply the first measurement signals to the processor for the transmission of the first measurement signals by the transmitter to the base station in order to determine in the base station the reaction time following the signalling of the starting signal of the race on the basis of a threshold of an increase in acceleration and/or of a speed of rotation of the personalized transponder module and to determine a possible false start if the reaction time is below the time threshold determined after the generation of the starting signal.

7. The measurement process according to claim 1, wherein the wake-up signal is received by the receiver of the personalized transponder module to activate the personalized transponder from the base station or an emitter at a race starting point of the athlete after a signalling for preparation of the start of an athletics race or directly at an instant of a starting signal generated by a starting gun shot of the measurement system.

8. The measurement process according to claim 1, wherein the athlete pushes against bearing blocks of a starting block for a start of an athletics race, and wherein the at least one motion sensor or sensors measure an acceleration and/or a rotation speed of the personalized transponder module positioned on an upper part of a body of the athlete for determination of a reaction time following the starting signal.

9. The measurement process according to claim 1, comprising:

determining a possible false start if the reaction time is below the time threshold determined and an angle of rotation of the personalized transmitter module is above a rotation threshold.

10. The measurement process according to claim 1, comprising:

generating the wake-up signal using the base station or an emitter arranged external to the personalized transmitter module.

11. A process for measuring or determining a reaction time of an athlete at a start of a race by means of a personalized transponder module positioned on the athlete and a base station of a measurement system, wherein the personalized transponder module comprises at least a signal receiver configured to receive signals, a processor for data, measurements or commands, a transmitter configured to transmit data and/or measurement and/or command signals, and at least one motion sensor including a gyroscope with one, two or three measurement axes to supply measurement signals to the processor, wherein the process comprises the following steps:

activating the personalized transponder module following receipt of a wake-up signal in the receiver, measuring a movement of the athlete by the at least one motion sensor following at least signalling of a starting signal of the race, transmitting the measurement signals directly or formatted with determination of variations in movement following the starting signal in the processor by the transmitter to the base station, and determining the reaction time of the athlete at the start of the race in the base station or using the processor of the personalized transponder module for determination of a possible false start if the reaction time is below a time threshold determined after generation of the starting signal, wherein the determination of a reaction time and the determination of a possible false start take into account a measurement of an angle of rotation of the personalized transponder module worn on an upper part of the body of the athlete and supplied in the measurement signals of the gyroscope, wherein the angle of rotation must be defined above a defined threshold to confirm a real start of the race of the athlete.

12. A system for measuring or determining a reaction time of one or more athletes at the start of a race, wherein the system comprises at least one personalized transponder module positioned on an athlete and a base station, wherein said at least one personalized transponder module comprises at least a signal receiver configured to receive signals, a processor for data, measurements or commands, a transmitter configured to transmit data and/or measurement and/or command signals, and at least one motion sensor to supply measurement signals to the processor, wherein the personalized transponder module is configured to be woken up by a wake-up signal provided by a transmitting device external to the personalized transponder module and received by the receiver in order to enable the at least one motion sensor to measure a movement of the athlete following a signalling of the start of the race, and wherein the base station or the processor is arranged to determine the reaction time at the start of the race on the basis of measurement signals from the motion sensor.

13. The measurement system according to claim 12, wherein the at least one motion sensor is an accelerometer with one, two or three measurement axes.

14. The measurement system according to claim 12, wherein the at least one motion sensor is a gyroscope with one, two or three measurement axes for the personalized transponder module configured to be positioned on an upper part of a body of an athlete.

15. The measurement system according to claim 12, wherein the at least one personalized transponder module, which is configured to be positioned on an upper part of the body of an athlete, comprises two motion sensors, which are an accelerometer with one, two or three measurement axes and a gyroscope with one, two or three measurement axes.

16. The measurement system according to claim 12, wherein the base station or the processor is arranged to determine the reaction time at the start of the race on the basis of a timing of an acceleration signal and a signal representing an angle of rotation of the at least one personalized transponder module.

17. The measurement system according to claim 12, comprising:

one of the base station and an emitter arranged external to the personalized transmitter module being configured to generate the wake-up signal.

* * * * *